United States Patent [19]

Schnaars

[11] Patent Number: 4,953,987

[45] Date of Patent: Sep. 4, 1990

[54] CONE TOP TO FLAT TOP FABRIC TRANSPORT BAG

[76] Inventor: Daniel R. Schnaars, 204 "A" Easy St., Lafayette, La. 70506

[21] Appl. No.: 287,262

[22] Filed: Dec. 6, 1988

[51] Int. Cl.[5] ..... B65D 33/16

[52] U.S. Cl. ..... 383/67; 383/32; 383/75

[58] Field of Search ..... 383/67, 75, 41, 24, 383/907, 32

[56] References Cited

U.S. PATENT DOCUMENTS

| | | | |
|---|---|---|---|
| 3,105,617 | 10/1963 | Felldin | 383/67 X |
| 3,789,897 | 2/1974 | Saito | 383/41 X |
| 4,211,266 | 7/1980 | Massey | 383/67 X |
| 4,364,424 | 12/1982 | Nattrass | 383/67 X |
| 4,524,457 | 6/1985 | Marino | 383/24 X |

*Primary Examiner*—Stephen Marcus
*Assistant Examiner*—Jes F. Pascua
*Attorney, Agent, or Firm*—Pravel, Gambrell, Hewitt, Kimball & Krieger

[57] ABSTRACT

The improved bag and method of the present invention introduces relates to a bulk bag which would include four (4) side portions, each of the side portions joined at their edges for forming a bulk container space therewithin, a susbstantially flat bottom portion attached to the side portions, with the bottom portion including a centrally positioned discharge spout, which would allow bulk contained within the bag to be discharged through the discharge spout. The bag would further include an upper top portion attached to the four (4) walls of the bag, the upper top portion being substantially cone - shaped, which may include an inlet spout at the top of the cone, for allowing bulk material to be poured into the bag. When bulk material is poured into the bag portion, the bulk material would form a cone of material within the cone portion of the bag, thus assuring that the walled portion of the bag has been filled with bulk. In closing of the bag, there is provided a draw string within the peripheral wall of the inlet spout, the draw string being in a position from the juncture between the spout and the top of the cone less than one half the diameter of the spout, so that upon constriction of the spout, via the draw string to closure, the cone portion of the bag would be drawn tight towards the center of the bag, so that the cone and the spout upon being tied off would form a flat top.

10 Claims, 5 Drawing Sheets

CONE TOP TO FLAT TOP FABRIC TRANSPORT BAG

BACKGROUND OF THE INVENTION

1. Field of the Invention

The present invention relates to bulk material transport bags. More particularly, the present invention relates to an improved bulk material transport bag when filled, due to a unique closure feature, enables the bag to remain closed as a flat top fully packed bag with enhanced stackability.

2. General Background

In the present state of the art of bulk bags, most of the bulk bags constructed incorporate a design which makes the bag practically impossible to totally fill. In bags which are being filled with bulk material, through an upper inlet spout, such bags would normally have a loose, non- pre-formed liner inserted into the bag, for receiving bulk material in order to avoid contamination. In order to fill, the bottom discharge would be tied off, and the liner would lay substantially loose in the bottom of the bag. Once the bag inlet spout has been positioned for receiving the material, the liner would normally be extending out of the top of the spout, so that the material can be poured into the bag with the liner conforming to the shape of fabric bag. In liners which are simply placed into the fabric bag and not attached therethrough through gluing or the like, the product enters the bag, and friction would tend to pull the liner down away from the upper corners. The incoming product together with the liner would then form a cone within the body of the bag, which would prevent the bag from filling completely. Therefore, when the bag is tied off for transport, a void space at the top is created after the cone due to the of product has been laid flat. This would create a void space and would allow product movement which may cause the bag to slump and bulge and even fall over when stacking is attempted.

Under the present state of the art, a flat top bulk bag is generally filled by hand packing the top portion of the bag. In most instances, a company would not want its employees to interrupt the filling cycle and hand pack the corners. Therefore, the bag must be sized extra tall—tall enough for accommodating the product cone during filling. This oversizing causes problems, more particularly three of concern:

(1) The higher costs of the taller bag;

(2) Poor handling characteristics since any empty space within the bag, not only allows the product to move, but causes the container to change shape. This change of shape can be in the form of slumping or bulging, and creates stacking problems; and (3) A taller bag requires more hang height for discharging the product from the bottom discharge. This extra needed height can prevent some companies from being able to utilize bulk bags at all.

Therefore, there is a need in the industry for a solution to this problem in properly filling bulk bags so as to avoid stacking problems during storage and shipment.

SUMMARY OF THE PRESENT INVENTION

The improved bag of the present invention relates to a bulk bag which would include four side portions, each of the side portions joined at their edges for forming a bulk container space therewithin, a substantially flat bottom portion attached to the side portions, with the bottom portion including a centrally positioned discharge spout, which would allow bulk contained within the bag to be discharged through the discharge spout. The bag would further include an upper top portion attached to the four walls of the bag, the upper top portion being substantially cone-shaped, which includes an inlet spout at the top of the cone, for allowing bulk material to be poured into the bag. When bulk material is poured into the bag portion, the bulk material would form a cone of material within the cone portion of the bag, after the walled portion of the bag has been completely filled with bulk. In closing of the bag, there is provided a draw string within the peripheral wall of the inlet spout, the draw string being a distance from the juncture between the fill spout and the top of the cone which would be less than the radius of the spout, so that upon constriction of the spout, via the draw string, material of the cone portion of the bag would be drawn tight towards the center of the bag, so that the cone and the spout, upon being tied off, would form a flat voidless top.

Therefore, it is an object of the present invention to provide a bulk bag having a cone-top, so that incoming product is able to rise above the bag shoulder until the proper weight is achieved;

It is further object of the present invention to provide a cone-shaped bulk bag having a cone top, so that after the proper weight of bulk is moved in the bag, the product cone may be leveled off, even or slightly above the bag shoulder, thus reducing the necessary bag height;

It is a further object of the present invention to provide an innovative new cone to flat top bulk bag which converts the cone top bag into a flat top style, eliminating any unfilled volume at the top of the bag and preventing slumping or bulging of the bag; and It is still an object of the present invention to provide an improved cone top bulk bag which enables the bag to go to a flat top bag upon the closure of the inlet spout in drawing the cone top to a flat top position after closure.

These and other objects of this invention will be readily apparent to those skilled in the art from the detailed description and claims which follow.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 2:
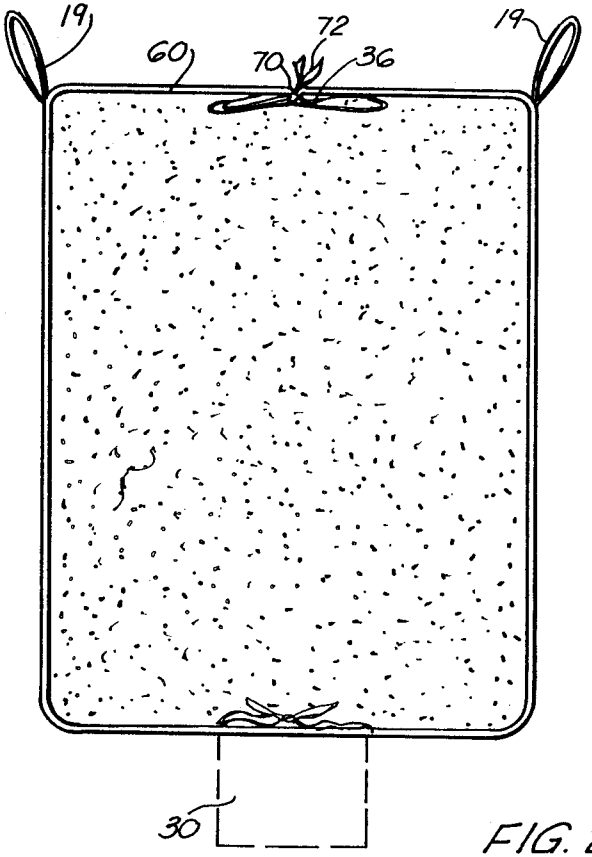
FIG. 2 represents the cross-sectional view of the improved bag closed off and filled with the product.
Figure 1:
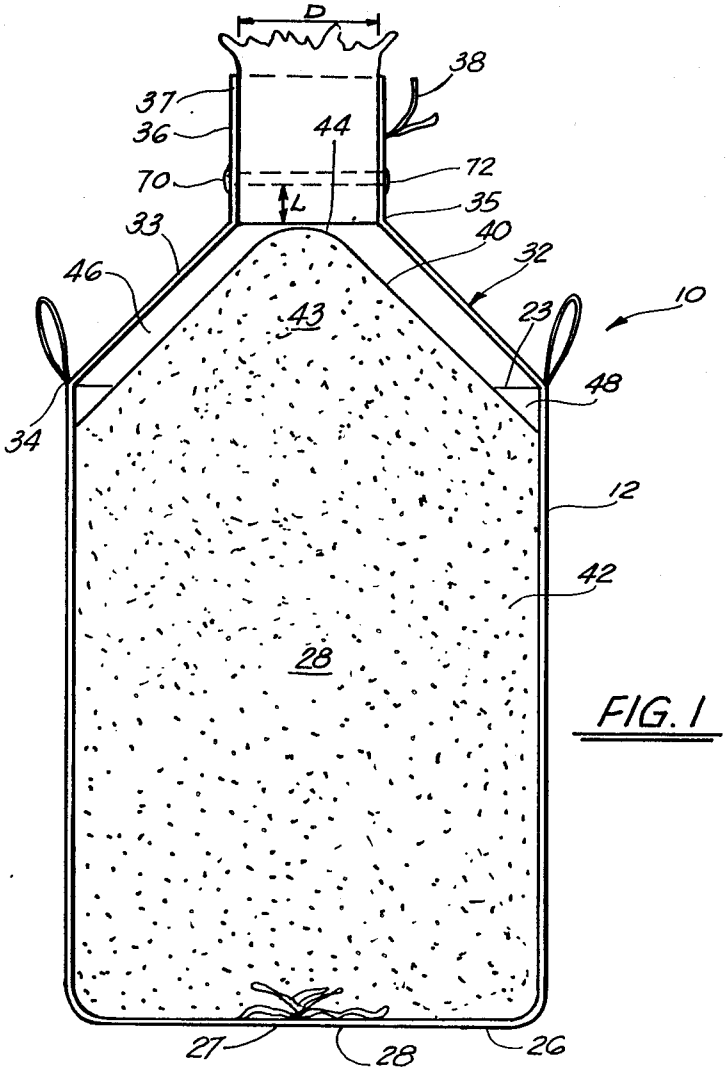
FIG. 1 illustrates cross-sectional view of the improved bag of the present invention.

FIGS. 1–7 illustrate the preferred embodiment of the apparatus of the present invention as indicated by the numeral 10. As seen in the Figures, apparatus 10 would comprise a fabric bulk material transport bag 12 having four sidewalls 14, 16, 18, and 20, each of the sidewalls forming a side panel and connected at their side edges 22 at each corner 24, for defining the composite bulk bag 12 as illustrated in the Figures. The four sidewalls would be attached to a substantially flat bottom portion 26, so that the four sidewalls 14, 16, 18, and 20, together with flat bottom portion 26 would define a bulk receiving space 28 therewithin. For purposes of construction, bottom portion 26 would include a substantially centrally located opening 27 to which a down spout 28 would be attached, for defining a lower bulk discharge tube 30, as illustrated in phantom view in FIG. 2. Of course while bulk is being poured or stored within bulk space 28, tube 30, as seen in FIGS. 1 and 2, has been closed off (FIG. 1) and in most cases stuffed within the lower portion against the floor portion 26 of bag 12, and would be reopened when bulk would be poured therefrom. There is further illustrated a plurality of lifting loops 19 at each top corner of the bag 12 for providing transport of the filled bag.

Turning now to FIG. 1, reference is made to a top portion 32 of bag 12 which comprises a substantially rectangular cone portion 33. The cone 33 is substantially square at its lower end 34 for conforming to the overall square shape of the upper ends 23 of each side wall, so that the lower end 34 of cone 33 is secured to the upper end 23 of each of the sidewalls, for defining the cone portion 33 as illustrated in FIG. 1. Cone 33 at its upper end would be truncated at point 35, having an upper substantially cylindrical inlet spout 36 secured to the truncated top 35 of cone 33, for defining an inlet opening 39 into which bulk material 40 is poured therethrough into bulk space 28.

For purposes of construction and use, the bulk space 28 as illustrated in FIG. 1, may well include an interior liner constructed of polyelethene plastic or the like, of the type which may be preformed or non-preformed. The non-preformed liner would be of the type having a continuous unformed side wall, and which would extend throughout the bulk space 28, so that when bulk would be poured within bulk space 28, the liner contained therein would conform to the shape of the bulk bag 12, and would serve as a means for protecting the bulk from contact with the outer fabric bag 12. For purposes of this invention, such a preformed or non-preformed liner may or may not be used with the present invention, depending on the type of bulk contained within the bulk space 28.

As seen in FIG. 1, upon bulk material 40 being poured into bulk bag 12, due to the nature of the weight of the bulk is poured in through the inlet spout 36, the bulk material would form a cone shape, having a generally rectangular quantity of bulk 42 contained within the four side walls of the bag, and a cone shape portion of bulk 43, due to the fact that the bulk is being poured in through the central spout 36, and forming a peak 44 of bulk material. However, due to bag 12 including a cone portion 33, the bulk material 43 in the cone portion 33 would, for the most part, fill the cone portion 33 although there may be a slight space 46 between the inner wall of cone 33, and the outer layer of bulk 43 within the cone portion 33.

It is critical to note, that due to the fact that the bag 12 contains a cone portion 33, it is seen that the bulk material 42, within the lower portion of the bag 12 is able to be poured substantially to the level of the upper point 23 of the sidewalls of the bag. Since the structure of cone 33 would enable this, and because of the fact that the bulk material 43 within the cone 33 would be laid flat as seen in FIG. 2, once the material is packed within bag 12, it is noted that the material which forms cone 43 would substantially fill the annular void 46 around the upper portion of the side walls of the bag, and therefore, would be accommodated as a rectangular quantity of bulk once the upper portion has been laid flat as seen in FIG. 2. Therefore, the four side walls of bulk bag 12 fully contain the necessary bulk that would be within bag 12, and therefore the bag would have the necessary bulk to fill the rectangular space 28 defined by the four side walls, however create a void as seen in FIG. 7.

Figure 7:
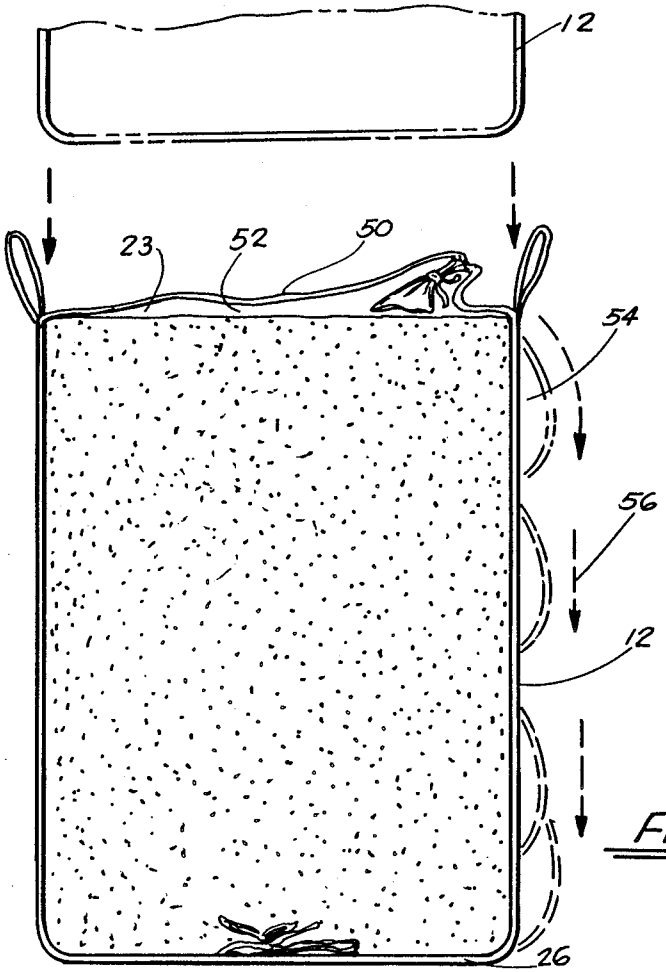
FIG. 7 illustrates a representational view of filled transport bags being stacked that were constructed according to the present invention.
Figure 5:
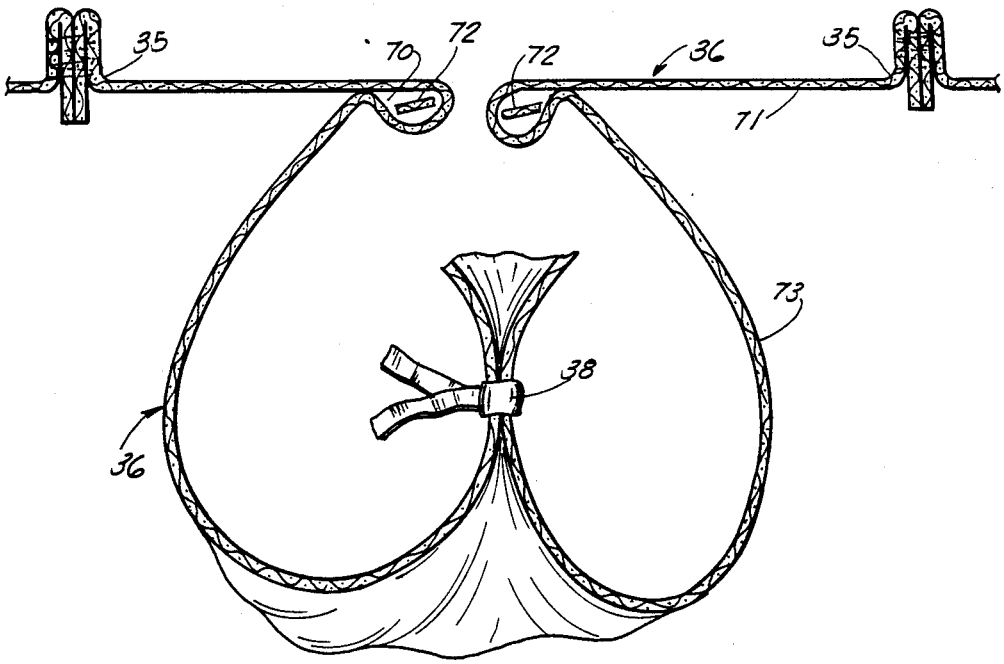
FIG. 5 illustrates a cross section view of the top portion of the improved bag closed off in the present invention.

Prior to going more fully into the nature of the present invention, reference is made to FIG. 7, which shows the problems which may be confronted in a bulk bag having a cone top, wherein the bulk material has filled the rectangular space defined by the four side walls as seen in FIG. 2. The problem which is confronted in the art at this point, is the fact that the cone which would no longer contain bulk after the bulk has been leveled, would define a loose quantity of fabric 50 (see FIG. 7), which would define a void space 52 between the fabric 50 of the cone 33 and the upper level 23 of the bulk 42 contained within the bag. Due to the fact that there would normally be air trapped within void space 52, upon a second bag 12 (as seen in phantom view in FIG. 7), being stacked upon lower bag 12, the air contained within space 52 may tend to shift and may form an air pocket 54, along the side of bag 12, which may somehow works its way down in the direction of Arrows 56 to the lower portion of bag 12, at the juncture of bottom wall 26 and one of the side walls, so as to define a void space on a corner, which may cause tilting of the bag during stacking and of course may result in the stacked bags falling. Therefore, in a cone shaped bag it would be most helpful if one were to eliminate the void space 52 created by the leveling of the bulk material 42 that was once contained in the shape of a cone 43 as seen in FIG. 1.

As part of the present invention, in order to solve the problem of the air space created in cone top bags filled under the present state of the art, applicant's bulk bag would include a means for constricting a portion of the fabric 50 comprising the cone 33 to form a flat upper surface 60, as seen in FIG. 2, after the bulk material has been leveled off. Turning to FIG. 1, there is illustrated along upper inlet spout 36, a tie 38, which one would use to tie off the end portion 37 of spout 36, after the bag is filled with bulk.

As further illustrated in FIG. 1, along the length of spout 36 there is also included an annular channel 70 which is actually formed by looping and stitching the fabric to form the continuous annular channel 70 around the wall of inlet spout 36 through which a length of tie cord 72 may be threaded. For purposes of construction, the annular channel in effect, divides inlet spout 36 into an upper spout portion 73, and a lower closure portion 75, the closure portion 75 being defined as that portion between the annular channel 70 and point 35, which is the connecting point between the cone portion 33 and the spout 36. As will explained further, it is imperative that the length (L) of the closure portion 75 of spout 36, which is defined by that distance between channel 70 and upper point 35, be less than one half the diameter (D) of spout 36, the reason to be explained further.

Figure 3:
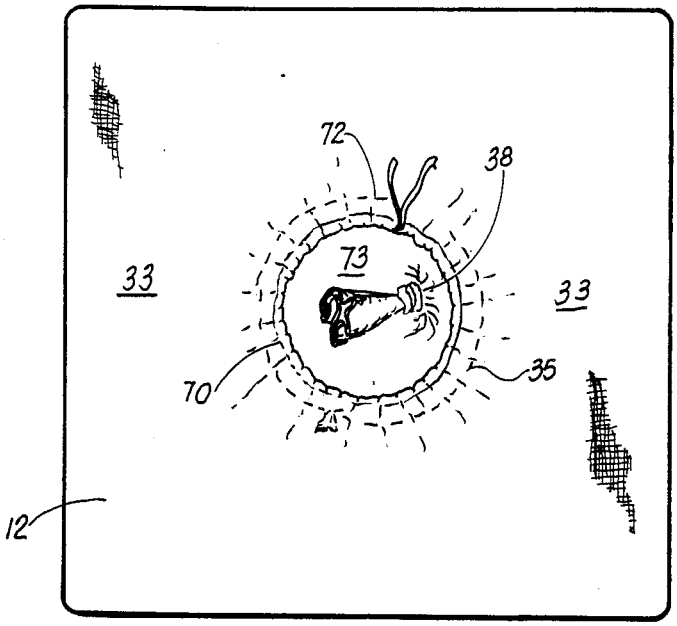
FIG. 3 illustrates a top view of the top portion of the improved bag in the open position.
Figure 4:
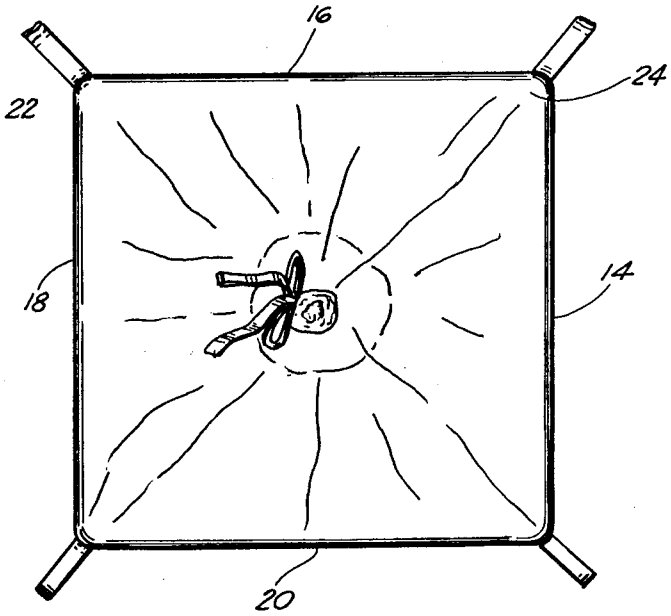
FIG. 4 illustrates a top view of the bag portion of the improved bag in the closed position with the cone top drawn tight to form the flat closure.

Turning now to the manner in which the flat top bag is formed against bulk 28 within the bag (as illustrated in FIG. 2), following the filling of the bag with the bulk 42 as seen in FIG. 1, the bulk within bulk space 28 is then leveled off via shaking or the like. Following the leveling off of the bulk, which would normally level off at the upper end 23 of the bag, the inlet portion of inlet spout 36 would then be tied off via cord 38, and would then be stuffed into the interior of the bag, as illustrated in FIG. 3. Upon the stuffing of inlet spout 36 into the bag, it is noted in FIG. 3, that due to the length (L) of closure portion 71 being less than half of the diameter (D) of the inlet spout 36, when laid in the flat position, does not fully close the bag, due to its reduced length. Therefore, cord 72 (as seen in FIG. 4), when pulled to fully constrict the opening 73 must in effect draw the fabric of conical portion 33 inwardly so that the iris opening may be fully constricted as illustrated in FIG. 4. When this is undertaken, what would normally be extra fabric which makes up of conical portion 33 as illustrated in FIG. 6, has now become drawn taut, as illustrated in FIGS. 2 and 4, and therefore the flat top bag is formed with the flat conical top formed tightly against the upper face of bulk material 42 within bag 12.

Figure 6:
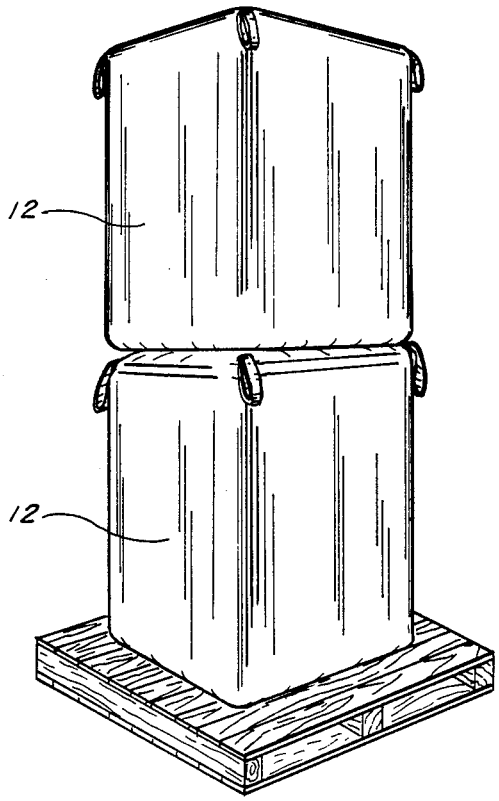
FIG. 6 represents two cone-to-top flat bags filled with products stacked upon one another.

When this is achieved, as seen in FIG. 1, rather than have the void space 52 as illustrated in the present state of the art in FIG. 7, one has configured a flat top, as illustrated in FIG. 2, thus eliminating void space 52, and allowing the bag to be squarely stacked upon the filled bulk bag as illustrated in FIG. 6.

Although in the principal embodiment, it is foreseen that the bulk bag as discussed in the present invention would include an inlet spout extending upward from the top of the truncated cone portion, for purposes of structure, it is foreseen that one may not include such an inlet spout, so that the bag would in effect end at the truncated cone portion, the draw string in actuality threaded through a channel around the opening of the truncated top portion. Therefore, the tightening of the draw string would in effect gather the material of the cone toward the center of the closure, to form the iris closure, and therefore may in effect, form the flat filled bag, thus eliminating the void in the cone top that is a problem in the present state of the art.

Figure 8:
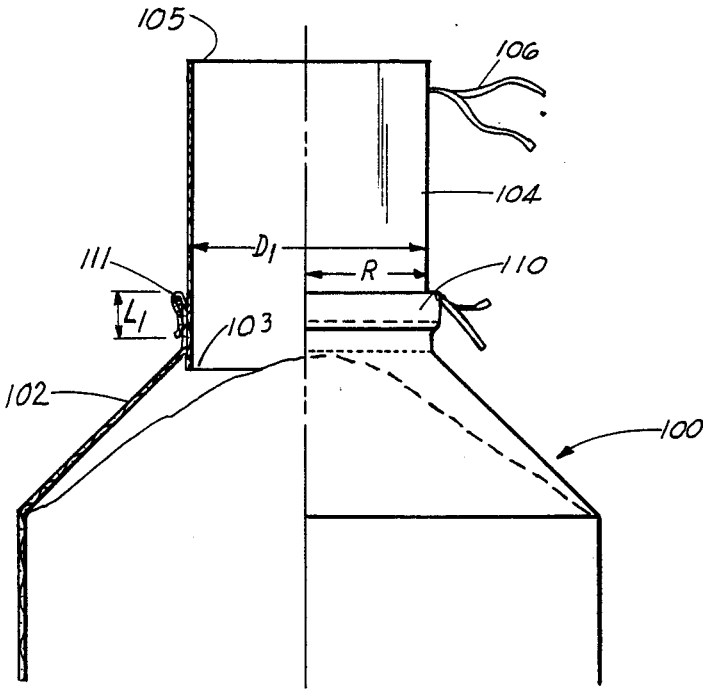
FIGS. 8 and 9 illustrate an alternate embodiment of the cone top to flat top bag closure in the present invention.
Figure 9:
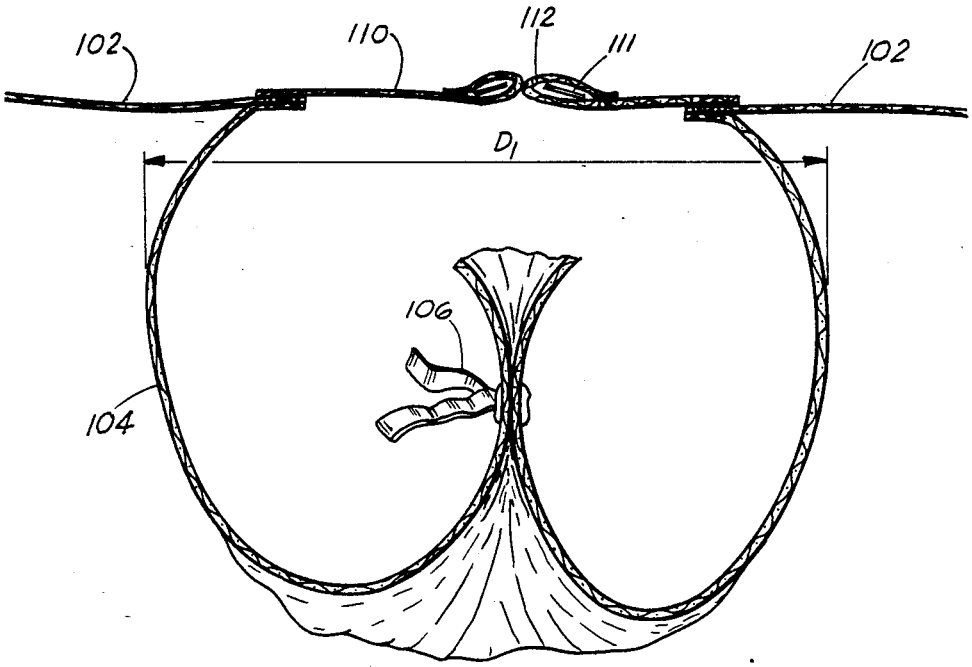

Furthermore, in an additional embodiment, as illustrated in FIGS. 8 and 9, there is illustrated a bulk bag 100, having a cone portion 102, with an upper opening 103 onto which a first elongated inlet spout 104 is sewn around the peripheral edge, so that bulk material may be introduced thereinto at its open end 105.

At the upper portion of the inlet spout 104 there is provided a tie 106, for tieing off the inlet spout 104 after the bulk has been poured into the bag, as illustrated in FIG. 8.

In this particular embodiment, rather than have the draw cord formed in an annular channel in the wall of the inlet spout, as in the principal embodiment, there is provided a second closure spout 110, which, as seen in the Figures, has a draw cord 111 secured within a channel 112 formed by folding over the upper edge of the closure spout, so that following the tying off of the first inlet spout 104 via tie 106, and stuffing the spout into the bag, the closure spout 110 is drawn closed by the draw cord 111, to form the closure of the bag as seen in FIG. 9. However, as with the principal embodiment, the closure spout 110 is critical to the full closure of the bag into a flat top closure, in that the length (L1) of spout 110 must be a distance less than ½ the diameter (D1), as seen in FIG. 7, so that when the draw cord 111 is pulled to close off the inlet opening 103 in order to form a tight iris closure, fabric from the cone 102 must be pulled inwardly to allow the closure to be complete, as with FIG. 8.

Again, although it is foreseen that the single spout could accomplish the ends of this invention, as illustrated in FIGS. 1–7, this particular embodiment would foresee the use of an inner spout 104 and a closure spout 110 separate and apart from the inner spout 104 as illustrated in FIGS. 8 and 9.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A. fabric bag for storage of dry bulk material, the bag comprising:

(a) four side walls, and a bottom portion, for defining a bulk containing space therewithin;

(b) a top portion, secured to the four side walls, the top portion forming a truncated cone;

(c) an inlet spout secured to an upper end of the truncated cone, he inlet spout having a diameter (D) and defining an opening for introducing bulk into the bulk containing space of the bag;

(d) a channel formed along an outer peripheral wall of the inlet spout, the channel positioned a distance above a point of contact between the inlet spout and the upper end of the truncated cone which is less than half the diameter (D) of the inlet spout; and (e) a tie cord secured within the channel, so that constriction of the tie cord to form an iris closure of the inlet spout also draws fabric of the truncated cone inwardly so that when the bag is filled with bulk the truncated cone is laid substantially flat against the bulk upon full closure of the inlet spout.

2. The fabric bag in claim 1, further comprising a discharge spout secured to the bottom portion of the bag for discharging bulk from the bulk space of the bag.

3. The fabric bag in claim 1, wherein the four side walls and the bottom portion are secured to one another via stitching along the four corners and the bottom portion of the bag.

4. The fabric bag in claim 1, further comprising a liner positioned within the bag, for allowing bulk to be contained within the bag and not make contact with the fabric of the storage bag.

5. The fabric bag in claim 1, wherein the truncated cone portion of the bag further defines a means for allowing additional bulk to be poured into the bag above the container space formed by the four side walls and the bottom portion.

6. The fabric bag in claim 1, wherein the constriction of the tie cord in the iris closure includes sufficient material of the truncated cone, to lay substantially flat against the bulk material forming the excess bulk within the bag above the upper portion of the four side walls.

7. A bulk material transport bag, for transporting storage dry bulk material, the bag comprising:

(a) four side walls and a bottom portion, the four side walls and bottom portion defining a bulk material container space therewithin;

(b) a conical top portion formed on an upper end of the four side walls, defining means for pouring a greater quantity of bulk within the bag above the upper end of the four side walls;

(c) an inlet opening at the conical top portion, having a certain diameter, and defining means for receiving bulk into the bag;

(d) an annular channel positioned along an upper edge of the inlet opening formed along the inlet spout;

(e) a draw string housed within the annular channel, the draw string when pulled to its full length constricting the diameter of the inlet spout to a closed position; and (f) a portion of the material forming the conical top portion of the bag drawn to form a closure on constriction of the opening in the inlet spout by the draw string, so that the cone portion is pulled to a flat position substantially flush against the top layer of bulk material contained within the bag.

8. A bulk material transport bag, of the type for transporting storage dry bulk material, the bag comprising:

(a) four side walls and a bottom portion, the four side walls and bottom portion defining a bulk material container space therewithin;

(b) a conical top portion formed on the upper end of the four side walls, defining means for pouring a greater quantity of bulk within the bag above the upper end of the four side walls;

(c) a first inlet spout secured to an upper edge of the conical top portion and defining an inlet opening for receiving bulk into the bag and having a diameter D;

(d) a second closure formed around the first inlet spout;

(e) an annular channel formed in the wall of the second closure spout;

(f) a draw string housed within the annular channel, the draw string when pulled to its full length constricting the opening of the inlet spout to a closed position; and (g) the second closure having a length (L1) less than one half the diameter (D) of the first inlet spout so that a portion of the fabric forming the conical top portion of the bag is drawn to form the closure on constriction of the opening in the inlet spout by the draw string, and the cone portion is pulled to a flat position substantially flush against the top layer of bulk material contained within the bag.

9. The bag in claim 8, wherein the closure spout is closed to its fully closed position after the first inlet spout has been tied off and stuffed into the bulk space within the bag.

10. A bulk material transport bag, of the type for transporting storage dry bulk material, the bag comprising:

(a) four side walls and a bottom portion, the four side walls and bottom portion defining a bulk material container space therewithin;

(b) a conical top portion formed on the upper end of the four side walls, for defining means for pouring a greater quantity of bulk within the bag above the upper end of the four side walls;

(c) a inlet spout having a certain diameter and formed above the conical top portion, defining an inlet opening for receiving bulk into the bag;

(d) closure means formed along the wall of the inlet spout for closing off the spout after bulk has been poured into the bag, so that upon closing the inlet spout with the closure means, a portion of the fabric forming the conical top portion of the bag must be drawn inward to close the inlet spout and the fabric is pulled to a flat position taut against the top layer of bulk material contained within the bag.

* * * * *